United States Patent [19]

Gettinger

[11] Patent Number: 4,709,420

[45] Date of Patent: Dec. 1, 1987

[54] SHAMPOO CAPE WITH SPLASH GUARD

[75] Inventor: Lillian Gettinger, Boca Ratan, Fla.

[73] Assignee: Andre Fantasies, Inc., Ft. Lauderdale, Fla.

[21] Appl. No.: 12,289

[22] Filed: Feb. 9, 1987

[51] Int. Cl.[4] ..... A41D 13/04

[52] U.S. Cl. ..... 2/50

[58] Field of Search ..... 2/50, 174

[56] References Cited

U.S. PATENT DOCUMENTS 2,851,690 9/1958 Jennings ..... 2/50

3,031,676 5/1962 Larson ..... 2/50

4,611,354 9/1986 Jones ..... 2/174

4,615,047 10/1986 Matsuoka ..... 2/50

*Primary Examiner*—Werner H. Schroeder

*Attorney, Agent, or Firm*—Lilling & Greenspan

[57] ABSTRACT

A shampoo cape includes a splash guard or capelette which bridges the cape shoulder portions, when the cape is placed on the user, and is received within the sink in which the hair is to be washed or shampooed to deflect water from the hair into the sink and prevent water from impinging on the cape, the user's clothes and chair.

11 Claims, 7 Drawing Figures

FIG.1
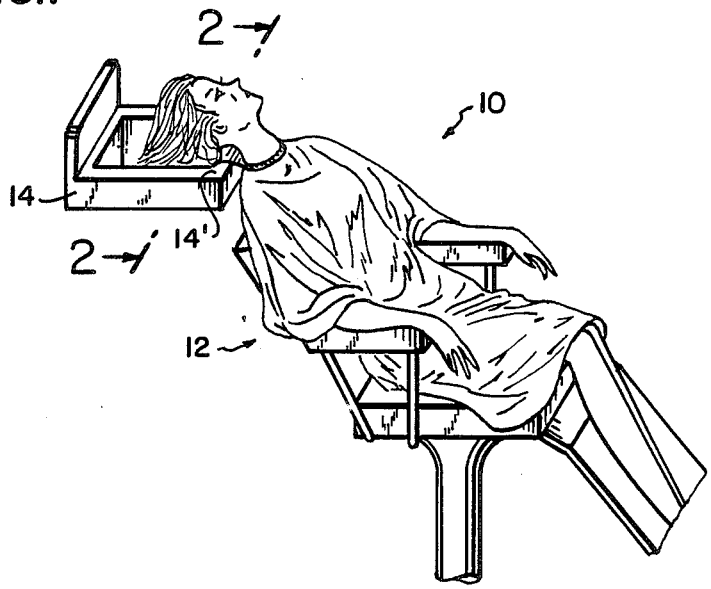
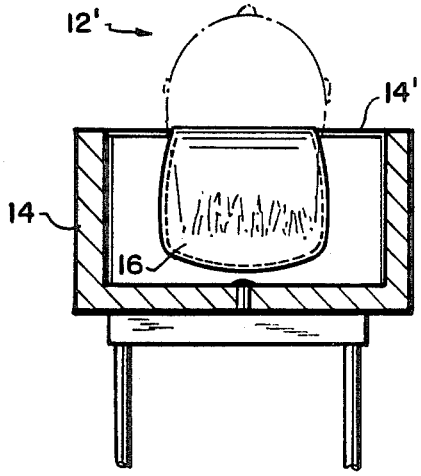
FIG.2
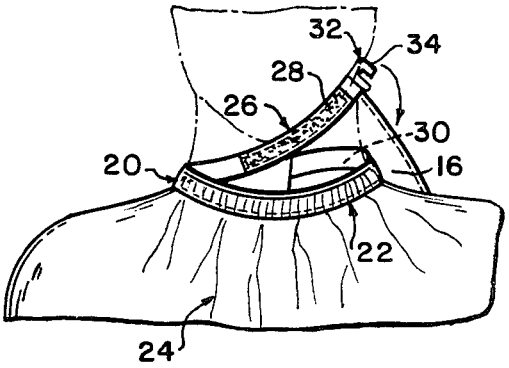
FIG.3

SHAMPOO CAPE WITH SPLASH GUARD

BACKGROUND OF THE INVENTION

1. Field of the Invention

The invention generally relates to beauty care products, and more specifically to a shampoo cape provided with a splash guard.

2. Description of the Prior Art

When hair is washed, as in a beauty salon, the customer typically sits in a chair and reclines rearwardly to place the hair to be washed into a sink where it is sprayed with a sprayer or nozzle. Various devices have been used to cover the customer in an attempt to prevent water from splashing or dripping from the hair onto the customer, the customer's clothes and/or chair. One such commonly used device is a plastic cape placed over the customer which has a front portion and rear portions draped over the shoulders of the customer. However, with vigorous washing and spraying of water, water could be deflected or splashed between the cape rear portions and onto the customer's clothes and/or the chair in which the customer is sitting. The only protection afforded to the customer with this known cape is the use of the plastic panel which forms the only water impervious barrier between the customer and the source of the water. However, this single barrier has not proved to be totally satisfactory for insuring dryness of the customer and/or the customer's clothes or chair.

SUMMARY OF THE INVENTION

In order to overcome the disadvantages inherent in the prior art protective covers, a shampoo cape in accordance with the present invention comprises a main panel made of water impermeable material and having a neck opening. Said panel defines a front portion and rear right and left shoulder portions draping the user when the user's neck is received through said neck opening. An additional splash guard or capelette is provided which is made of water impermeable material and which is attached to said main panel in the region of said neck opening. Said capelette generally being extendable over at least portions of said rear right and left shoulder portions and is adapted to be received within a sink into which the user's hair is placed to be washed or shampooed when the user sits in a chair and reclines rearwardly to place the hair into the sink. The construction, including said capelette, causes water to be deflected from the hair directly into the sink and substantially prevents water from impinging on said rear right and left shoulder portions, said front portion and the user's clothes and chair.

BRIEF DESCRIPTION OF THE DRAWINGS

The objects and advantages of the invention will be apparent from the following description and drawings in which:

FIG. 1 illustrates the general manner in which the shampoo cape in accordance with the present invention is used during washing or shampooing of hair;

FIG. 2 is an enlarged view along line 2—2 of FIG. 1, illustrating the manner in which the splash guard or capelette in accordance with the present invention is received within the sink in which the hair is washed or shampooed;

FIG. 3 is a front elevational view showing the construction details of the shampoo cape in accordance with the present invention, and more specifically, the construction in the region of the neck opening;

DESCRIPTION OF THE PREFERRED EMBODIMENT

Figure 4:
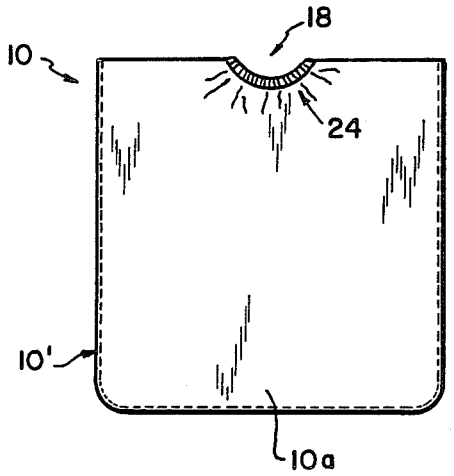
FIG. 4 is a front elevational view of the shampoo cape in accordance with the present invention.
Figure 5:
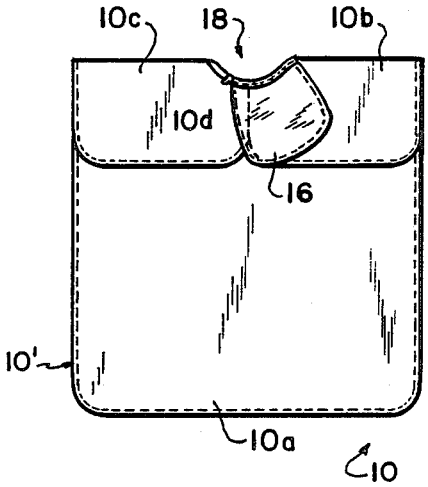
FIG. 5 is a rear elevational view of the shampoo cape shown in FIG. 4, showing the general position of the splash guard or capelette in relation to the rear right and left shoulder portions.

Referring now specifically to the drawings, in which the same or similar parts are designated by the same reference numerals throughout, and first referring to FIGS. 1 and 2, a shampoo cape in accordance with the present invention is generally designated by the reference numeral 10. The user of customer 12 is shown sitting in a chair in a rearwardly reclined position with the hair to be washed within a sink 14, the head resting on the front upper edge 14' of the sink 14.

Figure 6:
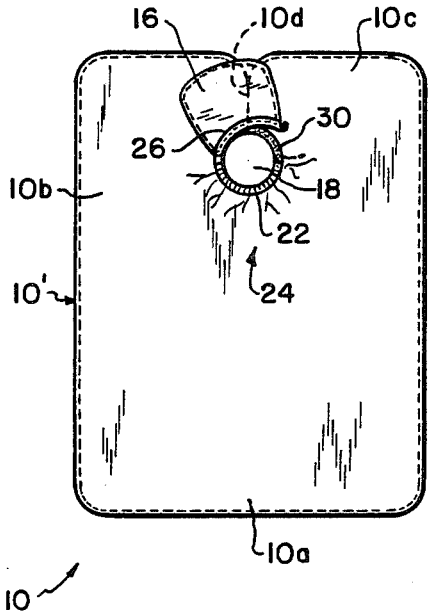
FIG. 6 is a top plan view of the shampoo cape shown in FIGS. 4 and 5, showing the shampoo cape laid out totally flat, and showing the position of the neck opening and the splash guard or capelette in relation thereto.
Figure 7:
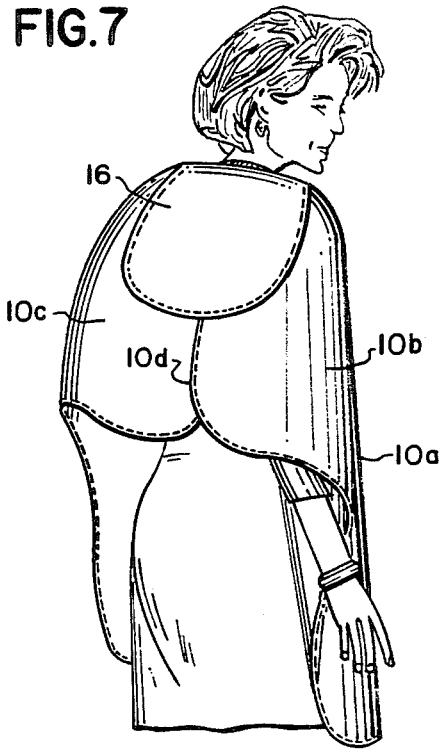
FIG. 7 illustrates how the shampoo cape in accordance with the present invention is generally draped over the user prior to use.

Referring to FIGS. 3–7, the shampoo cape 10 is shown to comprise a panel 10' (FIG. 6) made of a water-impermeable material, such as vinyl. The panel 10' includes a front portion **10*a* and rear right and left shoulder portions 10*b* and 10*c*, respectively, which drape the user as best shown in FIG. 7**.

An important feature of the present invention is the use of an additional splash guard or capelette 16 also made of water impermeable material, such as vinyl. A neck opening 18 is provided in the panel 10', and the capelette 16 is attached to the panel 10' in the region of the neck opening 18 and generally extends over at least portions of the rear right and left shoulder portions **10*b* and 10*c***.

The capelette 16 is adapted to be received within the sink 14 into which the user's hair is placed to be washed or shampooed when the user sits in the chair and reclines rearwardly as suggested in FIGS. 1 and 2. In this position, with the capelette in place as best shown in FIG. 2, the water is deflected from the hair directly into the sink 14 and water is substantially prevented from impinging on the rear right and left shoulder portions **10*b* and 10*c*, the front portion 10*a*** as well as the user's chair and garments worn underneath the shampoo cape.

While the general shape of the shampoo cape panel 10' is not critical, in a presently preferred embodiment the panel 10' is generally rectangular in shape as best shown in FIG. 6. Additionally, the precise position of the neck opening 18 is not critical for purposes of the present invention. However, in the presently preferred embodiment, the panel 10' has a predetermined length and the neck opening 18 is arranged proximate to one end of the panel 10'. In this manner, the front portion **10*a* is substantially longer than the length of the rear right and left shoulder portions 10*b* and 10*c*. As best shown in FIG. 6, the front portion 10*a* is shown to be approximately three times longer then the length of the rear right and left shoulder portions 10*b* and 10*c***.

Again referring to FIG. 6, the neck opening 18 is shown to be generally circular in shape and is provided with a neckband 20 which extends about the neck opening 18. The neckband 20 has a front neckband portion 22 which is gathered and elasticized to provided pleats 24 as shown in FIGS. 2, 4 and 6 to allow for stretching an adjustment of the neckband to the size of the neck of the user or customer 12.

The neckband 20 is also provided with a rear neckband portion 26 which substantially extends proximate to the rear right and left shoulder portions 10*b* and 10*c*. With this arrangement, the relative positions between the capelette 16 and the rear right and left shoulder portions 10*b* and 10*c* is substantially maintained irrespective of the user's or customer's neck size.

As best shown in FIGS. 2 and 6, the rear neckband portion 26 comprises two overlapping portions each associated with another one of the rear right and left shoulder portions 10*b* and 10*c*. Suitable connecting means is used on the overlapping portions for attaching the overlapping portions to each other when adjusted around the neck of the user. In the presently preferred embodiment, sucn connecting means comprises cooperating or mating Velcro connecting materials 28, 30.

In accordance with another feature of the invention, the rear neckband portion 26 is provided with an extra extension 32 which forms part of one of the overlapping portions to which there is connected a hook 34 for attachment to the neckband 20 to assure secure attachment in the adjusted condition.

The neckband 20 may be made of any suitable material. In the presently preferred embodiment, the neckband is made of Nylon Taffeta which provides both comfort to the user as well as water resistance and durability.

In the preferred embodiment, the rear right and left shoulder portions 10*b* and 10*c* generally define a parting line 10*d* (best shown in FIGS. 5 and 7) when the cape 10 is worn by the user, the capelette 16 being connected to one of the rear neckband portions and arranged to bridge the parting or separation line 10*d* and substantially equally overlap both the rear right and left shoulder portions 10*b* and 10*c* when the two rear neckband portions are attached to each other.

While the invention is described with reference to specific embodiments thereof and with respect to the incorporation therein of certain combinations of features, it is to be understood that the invention may be embodied in other forms, many of which do not incorporate all of the features present in this specific embodiment of this invention which has been described. For this reason, the invention is to be taken and limited only as defined by the claims that follow.

What is claimed is:

1. A shampoo cape comprising a panel made of water impermeable material and having a neck opening surrounded by a neckband having an extension at one end thereof, said panel defining a front portion and a rear portion including right and left shoulder portions draping the user when the user's neck is received through said neck opening, said right and left shoulder portions defining a parting or separation line; and a capelette made of water impermeable material attached to said panel in the region of said neck opening and to said neckband including its extension and generally extendable over at least portions of said rear right and left shoulder portions to bridge said parting or separation line and substantially overlap said rear right and left shoulder portions, said capelette being adapted to be received within sink into which the user's hair is placed to be washed or shampooed when the user sits in a chair and reclines rearwardly to place the hair into the sink to thereby deflect water from the hair directly into the sink and substantially prevent water from impinging on said rear right and left shoulder portions, said front portion and the user's chair.

2. A shampoo cape as defined in claim 1, wherein said panel is generally rectangular in shape.

3. A shampoo cape as defined in claim 2, wherein said panel has a predetermined length and said neck opening is arranged proximate to one end of said panel, whereby said front portion is substantially longer than said rear right and left shoulder portions.

4. A shampoo cape as defined in claim 3, wherein said front portion is approximately three times longer than said rear right and left shoulder portions.

5. A shampoo cape as defined in claim 1, wherein said neck opening is generally circular and has a neckband extending about said neck opening, said neckband having a front neckband portion bordering said rear right and left shoulder portions.

6. A shampoo cape as defined in claim 5, wherein said front neckband portion is gathered and elasticized to allow stretching and adjustment to the size of the neck of the user, whereby the relative positions between said capelette and said rear right and left shoulder portions are substantially maintained irrespective of the neck size.

7. A shampoo cape as defined in claim 5, whereby said rear neckband portion comprises two overlapping portions each associated with another of said rear right and left shoulder portions and connecting means on said overlapping portions for attaching said overlapping portions to each other when adjusted around the neck of the user.

8. A shampoo cape as defined in claim 7, wherein said connecting means comprises a hook and loop type fastener.

9. A shampoo cape as defined in claim 7, further comprising hook means at the end of at least one of said overlapping portions for attachment to said neckband to assure attachment in the adjusted condition.

10. A shampoo cape as defined in claim 5, wherein said neckband is made of material Taffeta.

11. A shampoo cape as defined in claim 11, wherein said panel and capelette are made of plastic material.

* * * * *